United States Patent [19]

Shohet

[11] 4,019,722

[45] Apr. 26, 1977

[54] HIGH INTENSITY MIXER UTILIZING A SINGLE SPEED MOTOR

[75] Inventor: Albert J. Shohet, Hamilton, Ohio

[73] Assignee: Littleford Bros. Inc., Florence, Ky.

[22] Filed: Nov. 28, 1975

[21] Appl. No.: 635,890

[52] U.S. Cl. ..... 259/105

[51] Int. Cl.[2] ..... B01F 7/00

[58] Field of Search ..... 259/105, 120, 182, DIG. 9; 310/78, 92, 100; 192/82 T

[56] References Cited

UNITED STATES PATENTS

| | | | |
|---|---|---|---|
| 1,997,035 | 4/1935 | Arbuckle | 259/105 |
| 3,630,495 | 12/1971 | Carroll | 259/182 |
| 3,792,697 | 2/1974 | Walter | 192/82 T |

*Primary Examiner*—Harvey C. Hornsby
*Assistant Examiner*—Robert Pous
*Attorney, Agent, or Firm*—Melville, Strasser, Foster & Hoffman

[57] ABSTRACT

The high intensity mixer utilizing a single speed motor of this invention includes a concentric pair of vertical shafts mounted in the mixer. In one embodiment a driven pulley is directly attached to the outer shaft which mounts the lower set of mixing tools and runs whenever the motor is running. The inner shaft bears the upper mixing tool and may be coupled to the outer shaft by any appropriate manual, pneumatic, fluid, centrifugal, electro-magnetic or air operated clutch means. Engagement and disengagement of the upper mixing tool may be accomplished by manual means or automatic means. Where automatic means are used they may be coupled to sensors reading temperature, amperage or other appropriate conditions.

In an exemplary operation the inner and outer shafts are clutched together so as to drive both the upper and lower mixing blades at the outset. As the temperature and/or horsepower requirements change, the clutch is disengaged allowing the upper mixing tool to free-wheel, thereby allowing a single speed motor and drive to be used for continuation of the mixing operation.

Depending upon the materials being mixed, it is possible that the power requirements are initially such that only a single blade is required, whereafter both sets of mixing blades may be required, in which event the lower set of blades is first operated and later the upper set of mixing blades is brought into operation by effectively clutching the inner shaft to the outer shaft at that time.

3 Claims, 2 Drawing Figures

HIGH INTENSITY MIXER UTILIZING A SINGLE SPEED MOTOR

BACKGROUND OF THE INVENTION

1. Field of the Invention

The invention is directed to an improvement in the driving of mixing tools used in the preparation of granular, pulverulent, liquid or pasty materials; a specific example is the mixing of polyvinyl chlorides. Present prior art workers generally utilize a vertical cylindrical mixing vessel having a vertically mounted power shaft mounted therein and supporting upper and lower mixing blades. The action of these blades produces both a mixing and a heating condition. It has heretofore been the practice to employ a variable speed, or two-speed, drive so as to regulate mixing in accordance with the increase or decrease in the power requirements as the mixing cycle progresses.

2. Description of the Prior Art

A preliminary patentability search was conducted in the United States Patent Office in an effort to develop those United States Patents disclosing mixing arrangements closest to that shown and claimed herein. No assertion is made, however, that the best art was developed by such search although that was indeed the purpose thereof. The United States Patents developed by that search are U.S. Pat. Nos.: 1,682,735; 1,925,152; 1,997,035; 2,015,244; 2,118,500; 2,668,694; 2,682,810; 2,721,062; 2,778,614; 2,784,950; 2,972,168; 3,194,504; 3,352,543; and 3,578,876.

U.S. Pat. No. 1,682,735 is an early reference illustrating separately driven concentric shafts. U.S. Pat. No. 1,925,152 illustrates apparatus for mixing ice cream and the like, again involving concentric shafts.

U.S. Pat. No. 1,997,035 also relates to an ice cream making device. Scrapers and beaters are mounted on concentric shafts. The scrapers are directly powered by an electric motor and the beaters may be engaged or disengaged with the same electric motor by clutch means so that the scrapers may operate during the preliminary chilling time and the beaters may be operated thereafter.

U.S. Pat. No. 2,015,244 illustrates a mixer for slaking lime having two hand-powered concentric shafts. U.S. Pat. No. 2,118,500 illustrates a mixer for "plastic" material such as bakery dough. Beaters, mounted on concentric shafts, may be driven at differential speeds or in unison; this is accomplished through the use of separate motors or of a single motor through variable speed drives which may be manually adjusted.

U.S. Pat. No. 2,668,694 illustrates a vertical, cylindrical mixing chamber provided with concentric shafts extending downwardly thereinto. The inner shaft is driven by motor 48 and the outer shaft is driven by motor 54 at different speeds to provide improved mixing.

U.S. Pat. No. 2,682,810 teaches a pulper having a large diameter, slow moving disc 40 to provide circulation, the disc 40 being attached to a shaft 42 driven by motor 48. A fast moving disc 30 is adapted to provide the defibering action and is carried on shaft 32 driven by motor 34. The shafts are concentric and are driven at different speeds.

U.S. Pat. No. 2,721,062 teaches a butter making device, again having concentric shafts driven at different speeds by separate hydraulic engines 42 and 45.

U.S. Pat. No. 2,778,614 illustrates a mixer having concentric shafts driven by a single motor. The shafts are intended not only to rotate at different speeds, but also in opposite directions. U.S. Pat. No. 2,784,950 describes a mixing machine for chopped meats and the like, a single motor again driving two concentric shafts at different speeds and in different directions. U.S. Pat. No. 2,972,168 relates to a mixing and extruding device utilizing concentric shafts, one shaft driving the other.

U.S. Pat. No. 3,194,504 is of interest in that it illustrates concentric shafts driven by separate motors mounted at either end of the mixing chamber. U.S. Pat. No. 3,352,543 illustrates separate mixing means which may be mounted on concentric shafts so as to be turned in the same or opposite directions at the same or different speeds. Again, however, two separate, variable speed motors are contemplated. Similarly, U.S. Pat. No. 3,578,876 illustrates a mixer having concentric shafts which may be coupled or uncoupled, again however more than one motor being required.

SUMMARY OF THE INVENTION

The high intensity mixer utilizing a single speed motor eliminates the motor shock which occurs in two-speed arrangements when accelerating and decelerating between speeds; heretofore this has been a touchy problem, particularly with the higher horsepower drives. The arrangement of this invention results in lower maintenance costs by eliminating the commonly used two-speed drive but while still maintaining the benefits of the two-speed motor. Maximum output for a specific motor size is achieved whereby increased capacities are realized with a minimum cost. Less moving parts are utilized and wiring is much more simple.

Normally at the beginning part of a mixing cycle, or at the ending part thereof, the power demand is either increased or decreased depending on the product mixed and other important requirements existing in a specific process. Heretofore, in order to compensate for the changes in power demand, two speed or variable speed drives have been used. This has resulted in expensive and complicated components that normally need more maintenance.

The proposed power optimumization of the high intensity mixer utilizing a single speed motor is accomplished with a prime mover, single speed, that utilizes more than one mixing element to achieve the maximum power absorption. If the power demand is increased or decreased during the mixing cycle, one or more of the mixing elements will be either engaged or disengaged to reduce or step-up the power demand during any portion of the mixing cycle. This can be done by manual clutching, pneumatic, fluid, centrifugal, or electromagnetic means. This, in essence, will result in activating or deactivating mixing elements to give better mixing, conserve the maximum power demand, and provide the necessary heat or cooling gradient for a specific product being processed.

An example of the improvement achieved by this invention can be illustrated by describing it briefly in regard to PVC (polyvinyl chloride) compounding machines. By using two sets of blades, and a single speed motor, the blades being clutchable one to another as desired, one being driven at all times the motor is in operation, the maximum energy input at the beginning of the cycle can be derived immediately, that is, at the very beginning of the cycle, rather than later on in the cycle, when the material becomes viscous. When the material is thoroughly mixed, and it starts to heat up on a sharp heat gradient, the viscosity of the compound will increase, and hence, the horsepower demand is also increased. At this point the speed must in effect be decreased to decrease the horsepower demand. By this invention this is achieved by deactivating one of the mixing elements whereby to maintain the horsepower demand at the same level required at the beginning of the cycle. It will thus be observed that this results in an economical and trouble-free arrangement wherein a single speed drive permits maximum power utilization without having to have a two speed feature.

More briefly stated, two or more blades are mounted on two independent shafts. The outer shaft may be driven by a series of v-belts connected to a single speed motor. The inner shaft may be clutched to the outer shaft by one of any number of means. When the material being processed is, for example, heated up to a certain set predetermined point, a heat sensor, or a timing device, or both, may be used to disengage one of the blade shafts from the other whereby to maintain the horsepower level within the capacity of the device.

DESCRIPTION OF THE PREFERRED EMBODIMENTS

Figure 1:
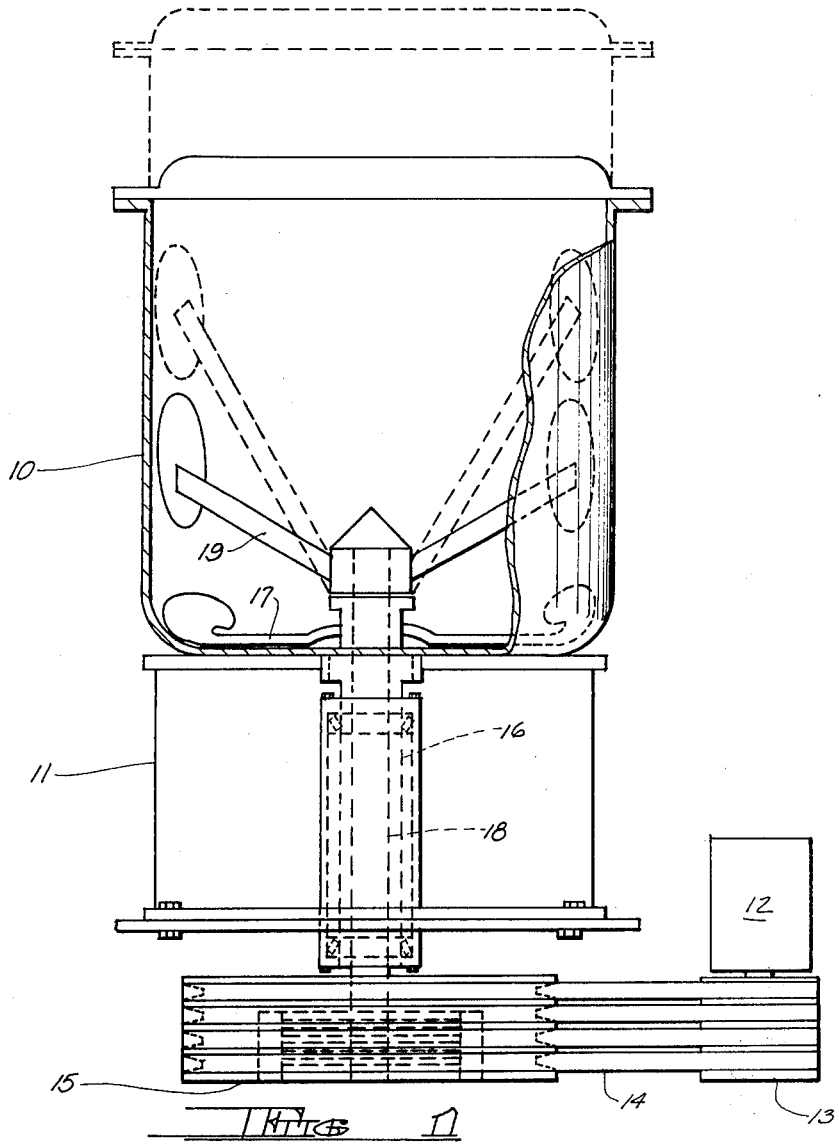
FIG. 1 is a front view of the high intensity mixer utilizing a single speed motor of this invention, partly in elevation and partly in section, with parts broken away and some aspects of the mixer being depicted schematically.

Referring first to FIG. 1 the invention is illustrated as embodied in a mixer comprised of a stationary bowl 10 mounted on suitable framework generally indicated at 11. Any conventional prime mover, preferably a single speed motor, is generally indicated at 12 and this may drive a pulley sheave 13 suitably connected as indicated at 14 to a pulley hub 15. The normally rotating pulley hub (when the prime mover 12 is in operation) has a driving connection to an outer mixing shaft 16 to which are affixed a lower set of mixing blades and the like 17. Rotatably mounted within the outer shaft 16, but normally free thereof, is an inner shaft 18 to which is affixed a set of upper mixing blades generally indicated at 19. (The dotted line extension of the mixing bowl 10, and the dotted line depiction of the upper set of mixing blades 19, simply illustrate the fact that the invention may be applied to various sized mixers.) It will be understood by those skilled in the art that all of the structures so far described may be mounted on suitable framework, not shown in detail, so as to constitute a complete mixing machine.

Figure 2:
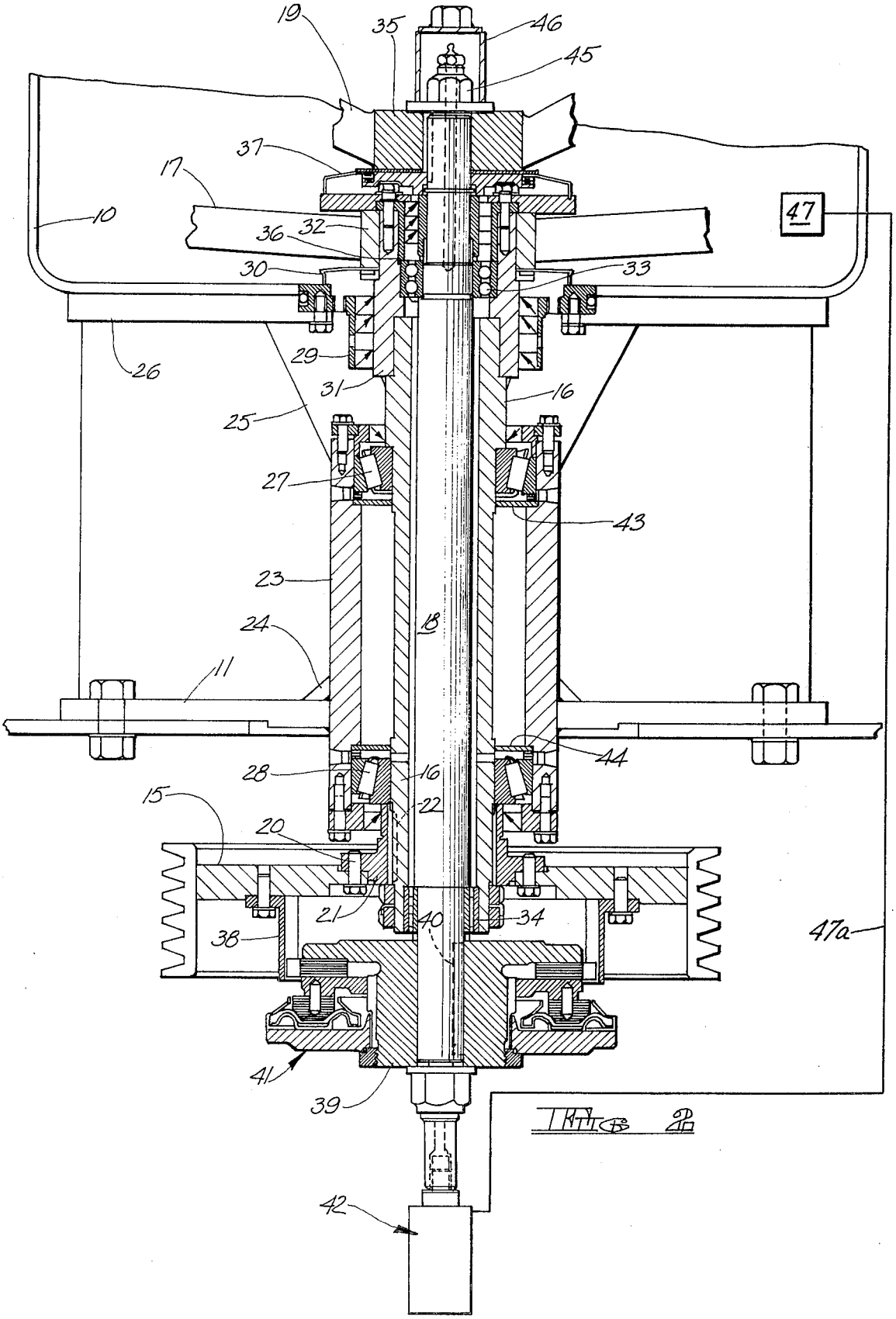
FIG. 2 is a fragmentary sectional view through the main components of the high intensity mixer utilizing a single speed motor of this invention.

Referring now to FIG. 2 the normally rotating (when the motor 12 is operating) pulley hub 15 is indicated at 20 as being affixed to a driving member 21 which is keyed or splined to the outer shaft 16 as indicated at 22. The outer shaft 16 is partially encased within a stationary housing 23 which contains certain bearings as will be described. The stationary housing 23 may be affixed to the frame structure 11 as indicated at 24 and additional structural members generally indicated at 25 will extend between the housing 23 and base 26 of the bowl 10 so as to insure rigidity throughout the mixer. Upper and lower bearings 27 and 28 respectively are provided for the outer shaft in conventional manner as will be understood by those skilled in the art. Preferably both a mechanical seal 29 and an air seal 30, both mounted on the bowl structure 10, 26, are provided in conjunction with the member 31 carried by the outer shaft 16 so as to effectively seal the shaft from contamination by the ingredients being mixed within the bowl. The lower set of mixing elements 17 are secured to the member 31 as generally indicated at 32 and, therefore, these elements will be continuously rotated as long as the outer shaft is rotated.

The inner shaft 18 normally is free-wheeling with respect to the outer shaft 16 and upper and lower bearings 33 and 34 are provided for such inner shaft 18. The upper set of mixing elements 19 is connected to the upper end of the inner shaft 18 via the member 35 which is affixed thereto. Mechanical and air seals 36 and 37 respectively are also provided for the inner shaft 18 so as to prevent it from being contaminated by the ingredients being mixed within the bowl 10.

The inner shaft 18, normally free of the outer shaft 16, may be connected to the outer shaft 16 for rotation therewith in various ways. An examplary showing is indicated in the lower part of FIG. 2. The element 38 is affixed to the pulley hub 15 and rotates therewith. The element 39 is keyed to the inner shaft 18 as indicated at 40 and, therefore, is normally stationary. A twin disc clutch (other conventional clutches will suffice as will be understood by those skilled in the art) is generally indicated at 41. When this clutch 41 is actuated it will effect a driving engagement between the members 38 and 39 whereby the inner shaft 18 will rotate with the outer shaft 16. A rotary valve generally indicated at 42 may be connected to a stationary air line (not shown) and this valve will control actuation of the clutch 41.

Spacing means 43 and 44 are generally indicated in connection with the upper and lower bearings 27 and 28 respectively for the outer shaft 16. Sealing means 29 may be an oil seal and the cooperating air seal may include the metallic sealing member 30 previously referred to. The nut assembly 45 and cap 46 may be placed in position above the upper impeller 35 whereby to aid in convenient assembly and disassembly of the various parts. A member 47, which may be a heat sensor, timing device, a combination thereof, or some other sensitive actuating means, will be actuated in accordance with the conditions within the mixing bowl, through wiring means 47A, to actuate the rotary valve 42 so as clutch the inner shaft 18 into and out of engagement with the outer shaft 16 as conditions require and as may be determined by one skilled in the mixing art.

Mixing equipment according to this invention efficiently controls heat, turbulence and mixing capability without the use of a multi-speed motor, at the same time, however, achieving the advantage of multi-speed motors without the added expense of motor control and associated maintenance problems.

It is to be understood by those skilled in the art that modifications may be made in this invention without departing from the scope and spirit thereof. It is to be further understood that while the invention has been shown and described in terms of certain structures and arrangements, the invention is not to be limited to these certain structures and arrangements except insofar as they are specifically set forth in the subjoined claims.

The embodiments of the invention in which an exclusive property or privilege is claimed are defined as follows:

1. A high intensity mixer utilizing a single speed motor, said mixer to be responsive to mixing conditions, said mixer comprising: a mixing bowl, a first set of mixing elements disposed for rotation in said bowl to effect mild agitation, a second set of mixing elements disposed for rotation in said bowl to effect increased agitation when operatively connected with said first set of mixing elements, a first rotatable shaft to which said first set of mixing elements is fixed for rotation therewith, a second rotatable shaft to which said second set of mixing elements is fixed for rotation therewith, said second shaft being free-wheelable with respect to said first shaft, a single speed motor, drive means connecting said first shaft to said motor so that said first shaft is rotatable at a certain speed when said motor is actuated, first connect means fixed to said first rotatable shaft for rotation therewith, second connect means fixed to said second rotatable shaft for rotation therewith, clutch means to selectively engage and disengage said first and second connect means to control mixing and process requirements, and a sensor for actuating said clutch means in response to mixing conditions in said bowl, whereby when said clutch means are actuated to engage said first and second connect means said second shaft will rotate with said first shaft at said certain speed and in the same direction, and whereby when said first and second connect means are disengaged said second shaft will free-wheel with respect to said first shaft.

2. The mixer of claim 1 in which said second shaft is coaxial with said first shaft.

3. The mixer of claim 2 in which said second set of mixing elements is disposed in said bowl above said first set of mixing elements.

* * * * *